United States Patent [19]

Mascher

[11] 4,099,526

[45] Jul. 11, 1978

[54] FILTER-TYPE GAS MASK AND BREATHING DEVICE ARRANGED IN A CARRYING CASE

[76] Inventor: Werner Mascher, Bismarckstr. 6, 1000 Berlin 41, Fed. Rep. of Germany

[21] Appl. No.: 746,070

[22] Filed: Nov. 30, 1976

[30] Foreign Application Priority Data

Dec. 2, 1975 [DE] Fed. Rep. of Germany ..... 2554601

[51] Int. Cl.[2] ..... A62B 7/10

[52] U.S. Cl. ..... 128/146.6

[58] Field of Search ..... 128/140 R, 142 R, 146, 128/146.2, 146.3, 146.6, 146.7, 147, 185, 186, 191 R, 195, 196, 198, 201, 202, 203, 205, 206, 208, 212

[56] References Cited

U.S. PATENT DOCUMENTS 3,277,890 10/1966 Warncke ..... 128/147

FOREIGN PATENT DOCUMENTS 877,864 5/1953 Fed. Rep. of Germany ..... 128/147

7,007,188 11/1970 Netherlands ..... 128/147

*Primary Examiner*—Robert W. Michell

*Assistant Examiner*—Henry J. Recla

*Attorney, Agent, or Firm*—Parmelee, Johnson, Bollinger & Bramblett

[57] ABSTRACT

A filter type gas mask enclosed within a carrying case and cover comprising shock absorbing means extending from a filter head within the enclosure towards inner sidewalls of said cover and said carrying case at the area where said carrying case is connected to said cover. The filter head is held firmly within the carrying case and cover and the shock absorbing means absorb shocks in all directions. The shock absorbing means include a chin support which additionally functions to prevent direct contact between the body of the user of said mask and the filter and filter head of said mask.

14 Claims, 2 Drawing Figures

FILTER-TYPE GAS MASK AND BREATHING DEVICE ARRANGED IN A CARRYING CASE

Figure 1:
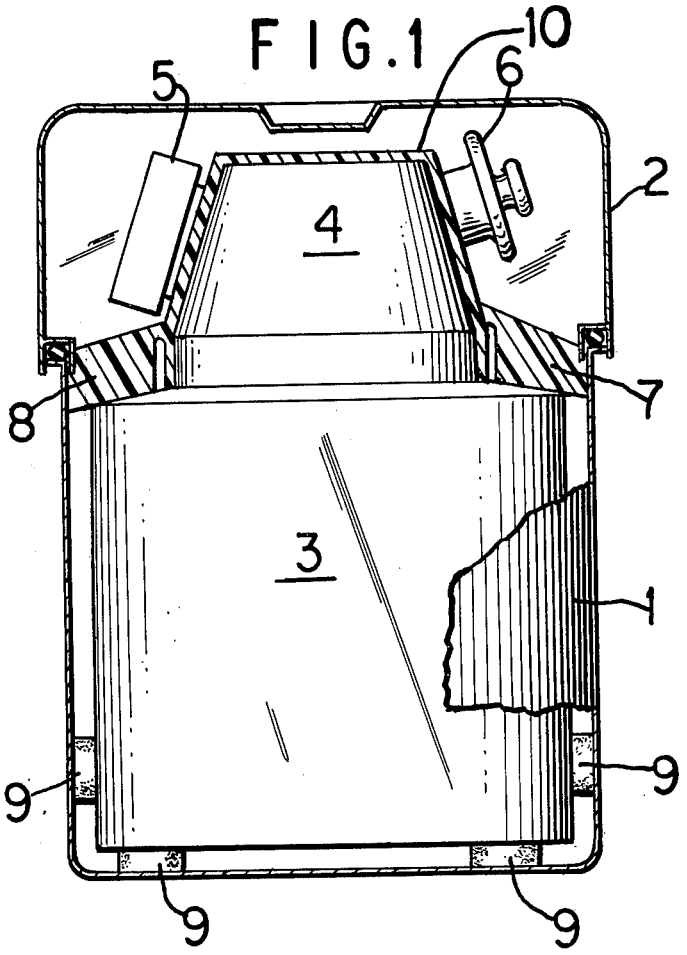

The present invention relates to a filter-type gas mask and breathing device arranged in a carrying case having impact-protection means positioned between the wall of the case and the mask in the upper region of the mask.

It is known to arrange anti-impact means in the region of the filter.

The object of the invention is to improve the protection against blows or impacts.

This objective is achieved in accordance with the invention in the manner that the blow-protection means are located in the region of the filter head.

In this way an improvement in the protection of the chemical against impacts and blows is obtained inasmuch as the filter head can act as additional buffer.

A further development of the invention resides in the fact that as impact protection there is used, on the one hand, the chin support which is in any event present and, on the other hand, a buffer lying diametrically opposite same.

It is further more proposed that the buffer be developed and arranged on the filter head in the same manner as the chin support.

Finally, it is advisable for the filter head to be held clamped fast in the container by the chin support and/or the buffer in such a manner that blows are intercepted from all directions.

Further details of the invention can be noted from the drawing in which an elevation and top view of a filter-type gas mask arranged in a carrying case are shown.

Figure 2:
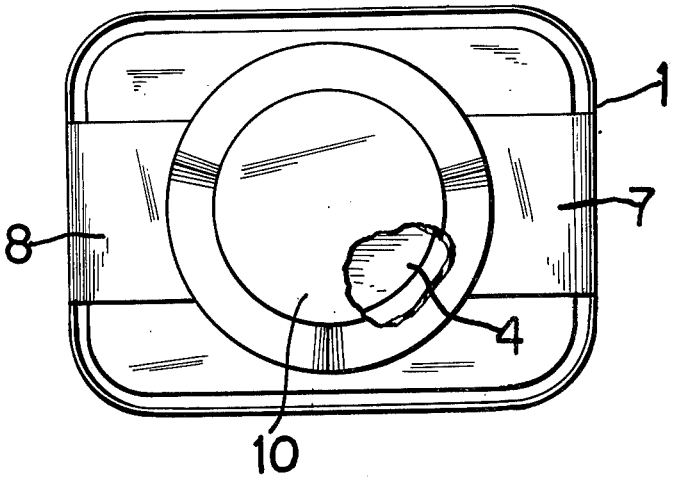

In the drawings:

FIG. 1 is an elevational sectional view of the filter-type gas mask arranged in its carrying case; and FIG. 2 is a top view of the filter-type gas mask in its carrying case without cover 2, mounth piece 6 and exhalation valve 5.

The lower portion of a carrying case is indicated at 1, 2 is its cover, 3 is the filter of a gas mask, 4 is its filter head, 5 is its exhalation valve, 6 is its mouthpiece, 7 is its chin support, and 8 is an additional buffer. The latter is developed and arranged on the filter head 4 in the same manner as the chin support 7.

The structural parts 7 and 8 serve as blow or impact protection for the filter 3 and the other parts, particularly the exhalation valve 5 of the apparatus. These impact-protection parts 7 and 8 preferably consist of rubber. Other impact-protection parts are shown at 9 which protect the lower portion of the apparatus from blows.

It is noted that the chin support cushion 7 and the impact-protection buffer 8 are located on diametrically opposite sides of the filter head 4. The overall distance between the outer sloping abutment surface of these two members 7 and 8 is slightly larger than the internal clearance within the cover and case so that when the cover 2 is installed on the lower portion of the carrying case 1, the filter head 4 is held firmly clamped in the case by these two impact absorbing members 7 and 8. Thus, any incident impacts or blows are absorbed from all directions.

What is claimed is:

1. A filter type gas mask arranged in a carrying case and a cover for said carrying case mounted thereon, said mask comprising;

a filter;

a filter head mounted on said filter;

said carrying case including a lower surface and sidewalls with an upper edge, said sidewalls extending perpendicularly upwards from said lower surface and terminating at said upper edge;

said cover including an upper surface and sidewalls with a lower edge, said sidewalls of said cover extending perpendicularly downwards from said upper surface and terminating at said lower edge, means for connecting said upper edge of said carrying case to said lower edge of said cover wherein said carrying case and said cover form an enclosed chamber;

said filter and said filter head being located within said enclosed chamber such that said filter head is in proximity to said cover and said filter is in proximity to said carrying case; and shock absorbing means connected to said filter head and extending outwardly therefrom in a direction towards said sidewalls of said cover and said sidewalls of said carrying case in the area where said sidewalls of said cover are connected to said sidewalls of said carrying case for holding said filter and said filter head firmly within said enclosed chamber formed by said carrying case and cover and for preventing contact between said filter and said filter head with any part of said carrying case and said cover by absorbing shocks and impact from all directions.

2. A filter type gas mask as claimed in claim 1 wherein said shock absorbing means are of equal dimension for holding said filter head in a position within said enclosed chamber which is equidistant from said sidewalls of said cover and equidistant from said sidewalls of said carrying case.

3. A filter type gas mask as claimed in claim 1 wherein said shock absorbing means extending outwardly from said filter head includes two buffers.

4. A filter type gas mask as claimed in claim 3 wherein said buffers are rubber.

5. A filter type gas mask as claimed in claim 3 wherein said buffers are positioned diametrically opposite each other.

6. A filter type gas mask as claimed in claim 1 wherein said second shock absorbing means include a plurality of outwardly extending buffers.

7. A filter type gas mask as claimed in claim 1 wherein said shock absorbing means comprises a buffer and a chin support extending outwardly from said filter head, said chin support preventing direct contact between the body of a user of said gas mask and said filter and filter head.

8. A filter type gas mask as claimed in claim 7 wherein said chin support and said buffer are positioned diametrically opposite each other on said filter head.

9. A filter type gas mask as claimed in claim 7 further comprising a mouthpiece affixed to said filter head.

10. A filter type gas mask as claimed in claim 9 wherein said chin support, said buffer and said mouthpiece are mounted on a single base, said base conforming to the shape of said filter head wherein said single base may be mounted directly upon said filter head.

11. A filter type gas mask as claimed in claim 7 wherein said chin support and said buffer are of the same dimensions for holding said filter head in a position equidistant from said sidewalls of said carrying case and said cover.

12. A filter type gas mask as claimed in claim 7 wherein said chin support and said buffer are rubber.

13. A filter type gas mask as claimed in claim 1 wherein said cover is connected to said carrying case by bending said edges of said sidewalls of said cover and said carrying case to complement each other.

14. A filter type gas mask as claimed in claim 1 further comprising second shock absorbing means connected between said filter and said carrying case for preventing impact between said filter and said carrying case.

* * * * *